United States Patent [19]

Akesaka

[11] Patent Number: 4,964,580

[45] Date of Patent: Oct. 23, 1990

[54] CRUSHING MACHINE

[75] Inventor: Toshio Akesaka, Yokohama, Japan

[73] Assignee: Kabushiki Kaisha Iseki Kaihatsu Koki, Tokyo, Japan

[21] Appl. No.: 367,545

[22] Filed: Jun. 16, 1989

[51] Int. Cl.[5] ..... B02C 19/00

[52] U.S. Cl. ..... 241/252; 241/254; 241/257 R; 241/261.1

[58] Field of Search ..... 241/248, 252, 253, 254, 241/257 R, 261.1, 224, 259.1

[56] References Cited

U.S. PATENT DOCUMENTS 1,164,762 12/1915 Simonds et al. ..... 241/152
4,199,113 4/1980 Genev ..... 241/152 X

OTHER PUBLICATIONS

"Screening, Classification and Crushing", published by Kinki Koggo Kabushiki Kaisha on Oct. 1, 1979. (Japanese text).

*Primary Examiner*—Mark Rosenbaum
*Attorney, Agent, or Firm*—Stoel Rives Boley Jones & Grey

[57] ABSTRACT

A crushing machine comprises crushing means including a first rotary member rotatable about a first axis; a second rotary member for crushing substances to be crushed in cooperation with the first rotary member, the second rotary member being rotatable about a second axis parallel to or inclined to the first axis and defining, in cooperation with the first rotary member, a crushing chamber for crushing the substances to be crushed, guide means for receiving the substances and the guiding the received substances to the crushing chamber; and drive means for rotating the first or second rotary member. Each rotary member includes a rotor, and the guide means includes a hopper. Each rotary member is disposed to be rotatable about a vertically extending axis or a horizontally extending axis.

7 Claims, 5 Drawing Sheets

CRUSHING MACHINE

BACKGROUND OF THE INVENTION

1. Field of the Invention:

This invention relates to a crushing machine for crushing stones and coals or the like and, more particularly, to a crushing machine suitable for collapsing massive substances.

2. Description of the Prior Art:

Conventional crushing machines for collapsing substances to be crushed include a gyratory crusher, a cone crusher or like crushing machine. Each of these crushing machines includes a cone cave, a conical rotor disposed in the cone cave so as to permit the eccentric turning motion and a drive mechanism for rotating the rotor. When crushing is done, the rotor turns in the cone cave at predetermined speed to thereby press the substances to be crushed against an inner surface of the cone cave. By so doing, the substances to be crushed are compressed and then crushed.

However, since the conventional crushing machine as noted above makes the rotor turn forcibly, it generates substantial vibration.

SUMMARY OF THE INVENTION

It is an object of the present invention to provide a crushing machine of which the crushing means is rotated not revolved.

A crushing machine according to the present invention comprises crushing means including a first rotary member rotatable about a first axis and a second rotary member for crushing substances to be crushed in cooperation with the first rotary member, the second rotary member being rotatable about a second axis parallel to or inclined to the first axis and defining, in cooperation with the first rotary member, a crushing chamber for crushing the substances to be crushed, guide means for receiving the substances and then guiding the received substances to the crushing chamber and drive means for rotating the first or second rotary member.

In a preferred embodiment, each rotary member includes a rotor, and the guide means includes a hopper. Further, according to one of the preferred embodiments, each rotary member is disposed to be rotatable about a vertically extending axis. According to another preferred embodiment, each rotary member is disposed to be rotatable about a horizontally extending axis.

The first and second rotary members have respectively first and second crushing surfaces for defining the crushing chamber in cooperation with each other. The first and second crushing surfaces are preferably formed into convex and concave surfaces respectively so that a distance between the first and second crushing surfaces is gradually reduced from an inlet for receiving the substances to be crushed toward an outlet for the use of crushed granular substances. In this case, each of the first and second crushing surfaces may be formed into a semispherical shape or a conical shape.

Preferably, the crushing machine further comprises support means for supporting both the first rotary member and the guide means and defining a space for receiving the crushed granular substances from the crushing chamber. In this case, the support means preferably includes a first support member for supporting the first rotary member, a second support member removably connected to the first support member and a spacer interchangeably disposed between the first and second support members, wherein the second rotary member is supported by the guide means or second support member.

Preferably, the crushing machine further comprises first support means for supporting the guide means, second annular support means for rotatably supporting the first rotary member and supported by the first support means such that the second annular support means is angularly rotatable about a third axis displaced from the first axis, and means for regulating the angular rotating position of the second support means relative to the first support means. In this case, the regulating means preferably includes a spring for exerting such force as to rotate the second support means in the direction opposite to the rotational direction of the first rotary member, an arm mounted on the second support means and a stopper mounted on the first support means and capable of being brought into engagement with the arm.

Furthermore, it is preferable that the crushing machine has the first and second rotary members arranged to make the first axis parallel to the second axis and that the portions of the first and second rotary members defining the outlet for the use of granular substances are respectively formed into planes parallel to each other. In this case, the planes defining the outlet for the use of granular substances are preferably formed into planes orthogonal to the first and second axes.

The first or second rotary member is forcibly rotated by the drive means, while the other is rotated following the rotation of the initially rotated rotary member when the substances to be crushed are guided to the crushing chamber and into engagement with both of the rotary members. At this time, both of the rotary members are rotated under the condition that their paths are eccentric since their respective axes of rotation are displaced from each other or cross each other.

Further, both of the rotary members may be forcibly rotated by the common drive means or different drive means.

When at least one of the rotary members is rotated, the first and second rotary members are made to bring about such relative motion that they come closer to each other at a portion around each of the first and second axes while they are separated away from each other at another portion. As a result, the substances to be crushed are sandwiched between the first and second rotary members and thereafter crushed according to the relative motion of both of the rotary members.

According to the present invention, since the first and second rotary members are only rotated about the first and second axes respectively without any rotary axis turning motion, the vibrations are remarkably reduced in comparison with the conventional crushing machine which imparts turning motion to the rotary members.

In the crushing machine of the present invention, both of the rotary members are preferably rotated in the same direction at high speed. By so doing, since not only the substances to be crushed but also the crushed granular substances are rotated at high speed, large centrifugal force acts on both the substances to be crushed and the granular substances, so that the substances to be crushed and granular substances may be forcibly moved. Accordingly, the capacity for processing is improved and the outlet of the crushing chamber for the use of granular substances may be reduced in size in comparison with the conventional crushing machine, in which the crushed substances are dropped from the crushing chamber by the gravity.

According to one aspect of the invention, since the substances to be crushed are easily put between the first and second crushing surfaces, the substances to be crushed may be securely crushed to improve the capacity for processing.

According to another aspect of the invention, since the crushed granular substances are received on the support means, it is possible to prevent the granular substances from spattering and a discharge port for discharging the granular substances may be disposed in any direction around the crushing chamber.

According to another aspect of the invention, since use is made of a spacer of the proper thickness, it is possible to change each gap between the first and second crushing surfaces, the gap between the respective portions of the outlet of the crushing chamber for the use of granular substances and the relative positional relationship between the first and second rotary members.

According to another aspect of the invention, when the second support means is rotated about the third axis, the angular rotating position of the second support means relative to the first support means is changed, so that the displacement between the first and second rotary members is changed. Therefore, the displacement between both the rotary members may be easily adjusted to thereby adjust the capacity for processing depending upon the kind of substances to be crushed.

According to another aspect of the invention, since the displacement between the first and second rotary members is lessened when a load acting on the drive means is large, while the displacement as noted above is increased when the load is small, the capacity for processing may be automatically adjusted depending upon the kind, size and quantity of substances to be crushed, so that the optimum processing efficiency may be always maintained.

According to another aspect of the invention, each gap between the respective portions of the outlet for the use of granular substances around each of the first and second axes may be held constant.

According to another aspect of the invention, even if the displacement between the first and second rotary members is changed, any gap between the respective portions of the outlet for the use of granular substances around each of the first and second axes is not varied.

BRIEF DESCRIPTION OF THE DRAWINGS

The foregoing and other objects and features of the invention will become apparent from the following description of preferred embodiments of the invention with reference to the accompanying drawings, in which.

DESCRIPTION OF THE PREFERRED EMBODIMENTS

Figure 1:
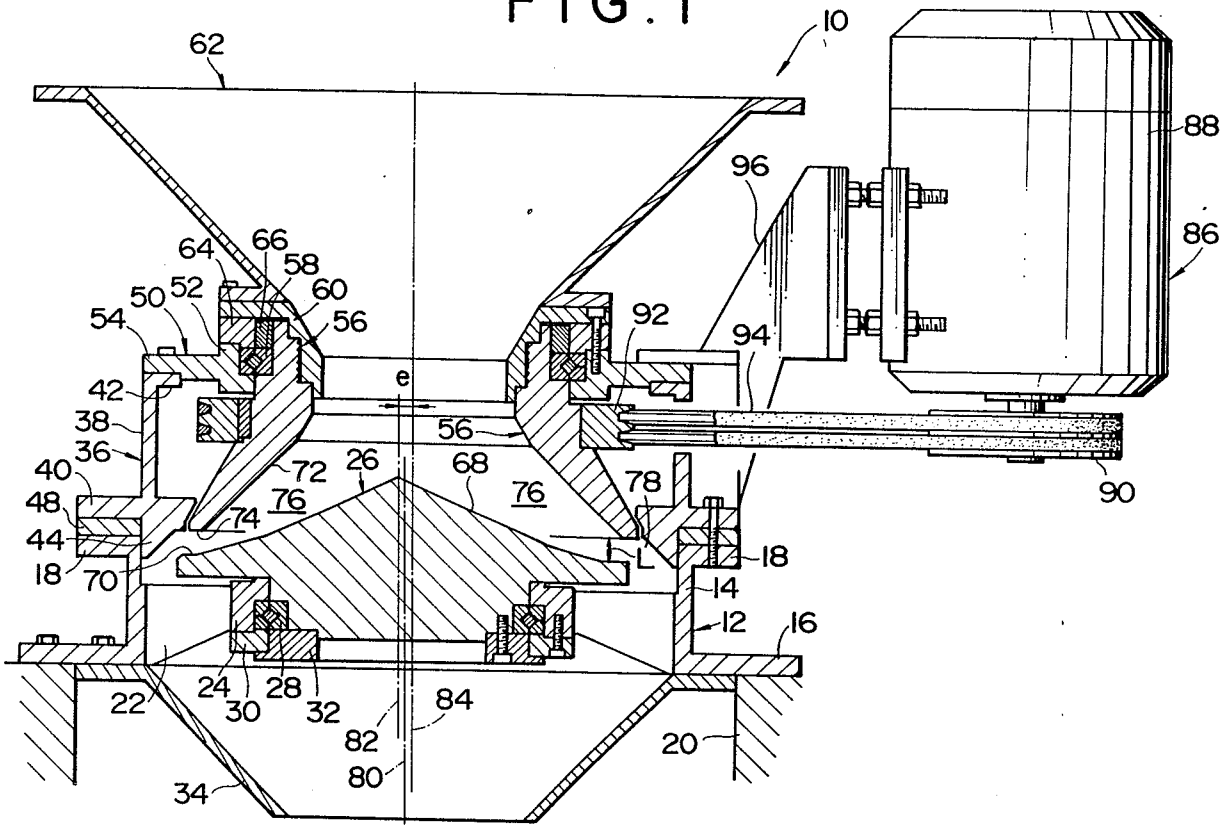
FIG. 1 is a longitudinal cross-sectional view showing an embodiment of a crushing machine according to the present invention.

A vertical crushing machine 10 as shown in FIG. 1 comprises a tubular body 12. The body 12 includes a cylindrical main body 14 and flanges 16, 18 provided on opposite ends of the main body in the axial direction. The body 12 is installed on a frame bed 20 in the lower flange 16 by a plurality of bolts so that an axis of the main body 14 extends in the vertical direction.

A plurality of arms 22 extending inwardly from an inner surface of the main body 14 are provided in the body 12 and fixedly attached to a boss 24. A first rotor 26 is rotatably supported by the boss 24 through a bearing 28. The boss 24 and first rotor 26 are arranged so that their axes extend in the vertical direction.

Holders 30, 32 for the use of the bearing 28 are respectively mounted on the boss 24 and first rotor 26.

A chute 34 for receiving crushed granular substances is mounted on the lower flange 16. A tubular casing 36 is disposed on the upper flange 18 so as to extend in the vertical direction.

The casing 36 is provided with a cylindrical main body 38 extending in the vertical direction, a flange 40 provided on a lower end of the main body, an inward flange 42 provided on an upper end of the main body 38, and an annular projection 44 projecting downwardly and inwardly from the lower end of the main body 38. The lower flange 40 is removably fixed in position to the body 12 by a plurality of bolts so that the flange 40 confronts the flange 18 of the body 12 through a spacer or a ring 48 and an axis of the casing 36 is coincident with that of the body 12. The projection 44 is fitted in an upper portion of the body 12.

A bearing carrier 50 is mounted on an upper portion of the casing 36 by a plurality of bolts. The bearing carrier 50 is provided with a boss 52 and a flange 54 extending outwardly from the boss. Further, the bearing carrier 50 is mounted on the casing 36 in the flange 54 so that an axis of the boss 52 extends in the vertical direction.

A tubular second rotor 56 is rotatably mounted on the boss 52 through a bearing 58 while a cover 60 for protecting the bearing 58 and a hopper 62 for receiving the massive substances to be crushed are mounted on the boss 52 by a plurality of bolts. In the illustrated embodiment, use is made of a cross roller bearing as the bearing 58. Further, the bearing 58 is prevented from dropping out of the boss 52 and second rotor 56 by the use of a bearing holder 64 mounted on the boss 52 and a bearing holder 66 mounted on the second rotor 56.

The second rotor 56 is disposed a distance above the first rotor 26. The first rotor 26 has a conical convex surface 68 and a flat upward surface 70 continuous with the foot of the convex surface, which are located on the side of the second rotor 56. On the contrary, the second rotor 56 has a conical concave surface 72 and a flat downward surface 74 continuous with a lower end of the concave surface, which are located on the side of the first rotor 26.

The first and second rotors 26, 56 are so disposed that they define an annular crushing chamber 76 with the convex surface 68 and concave surface 72 and also define an outlet 78 for the use of crushed granular substances with the surfaces 70, 74. A vertical angle of the convex surface 68 is larger than that of the concave surface 72. Accordingly, the gap between the convex surface 68 and the concave surface 72 is gradually reduced from the port for receiving the substances to be crushed into the crushing chamber 76 toward the outlet 78.

The surfaces 70,74 make a right angle with respect to an axis of the body 12 and that of the casing 36, that is, an axis 80 of a portion where both the body 12 and the casing 36 are fitted to each other. Therefore, a gap between the surfaces 70, 74 at each portion of the outlet 78 around the axis 80 is held constant. However, a gap L at the outlet 78 may be varied by disposing the ring 48, which is of a suitable thickness, between the body 12 and the casing 36.

The first rotor 26 is disposed so as to be rotatable about an axis 82 which is displaced from the axis 80 in one direction by a distance of a half of "e". On the contrary, the second rotor 56 is disposed so as to be rotatable about an axis 84 which is displaced from the axis 80 in the direction opposite to the aforementioned direction by a distance of a half of "e". Therefore, by changing the position where the casing 36 is mounted on the body 12 around the axis 80, the eccentricity between the first and second rotors 26, 56 may be varied within the range from 0 to "e". Further, the axes 80, 82 and 84 may be inclined to each other slightly, preferably by an equal angle.

A drive mechanism 86 includes a rotary mechanism 88 provided with a motor and a reduction gear, a pulley 90 fixedly attached to an output shaft of the rotary mechanism, a pulley 92 fixedly attached to the second rotor 56 and a plurality of belts 94 trained over both of the pulleys 90, 92. The rotary mechanism 88 is supported on a bed 96 fixedly attached to the casing 36 by a plurality of bolts.

Further, instead of rotating the second rotor 56, the first rotor 26 may be rotated or both of the rotors 26, 56 may be rotated by the identical drive mechanism or different drive mechanisms.

In operation, the second rotor 56 is rotated about the axis 84 by the drive mechanism 86 at high speed, and the substances to be crushed are dumped into the hopper 62. While the substances to be crushed are not in engagement with the convex surface 68 and concave surface 72, the first rotor 26 is not rotated. However, when the substances to be crushed are sandwiched between the first and second rotors 26, 56, the first rotor 26 is rotated following the rotation of the second rotor 56.

When the first and second rotors 26, 56 are rotated, the rotors 26, 56 are made to bring about such relative motion that they come closer to each other at a portion around each of the axes 82, 84 while they are separated away from each other at another portion, since the first and second rotors are respectively rotated about axes 82 and 84 spaced apart from each other by a distance indicated by "e". As a result, the substances to be crushed, which are sandwiched between the first and second rotors 26, 56 are crushed by the rotors 26, 56 when the gap between the rotors 26, 56 is narrowed.

The crushed granular substances are moved to the outlet 78 in the crushing chamber 76 by centrifugal force with the rotation of both of the rotors 26, 56, and then moved from the outlet 78 in the body 12 to be finally dropped into the chute 34.

According to the crushing machine 10, since the first and second rotors 26 and 56 are only rotated about the axes 82 and 84, respectively, the vibrations are reduced in comparison with the conventional crushing machine which imparts turning motion to the rotor and it is not necessary to provide a counterweight for damping the vibrations. Further, since the crushed substances are forcibly sent out of the crushing chamber 76 by the centrifugal force, the capacity for processing is remarkably improved in comparison with the conventional crushing machine, in which the granular substances are dropped from the crushing chamber by gravity. Furthermore, since the gap of the outlet 78 is held constant, this gap may be reduced in size in comparison with the conventional crushing machine which imparts turning motion to the rotor.

Figure 2:
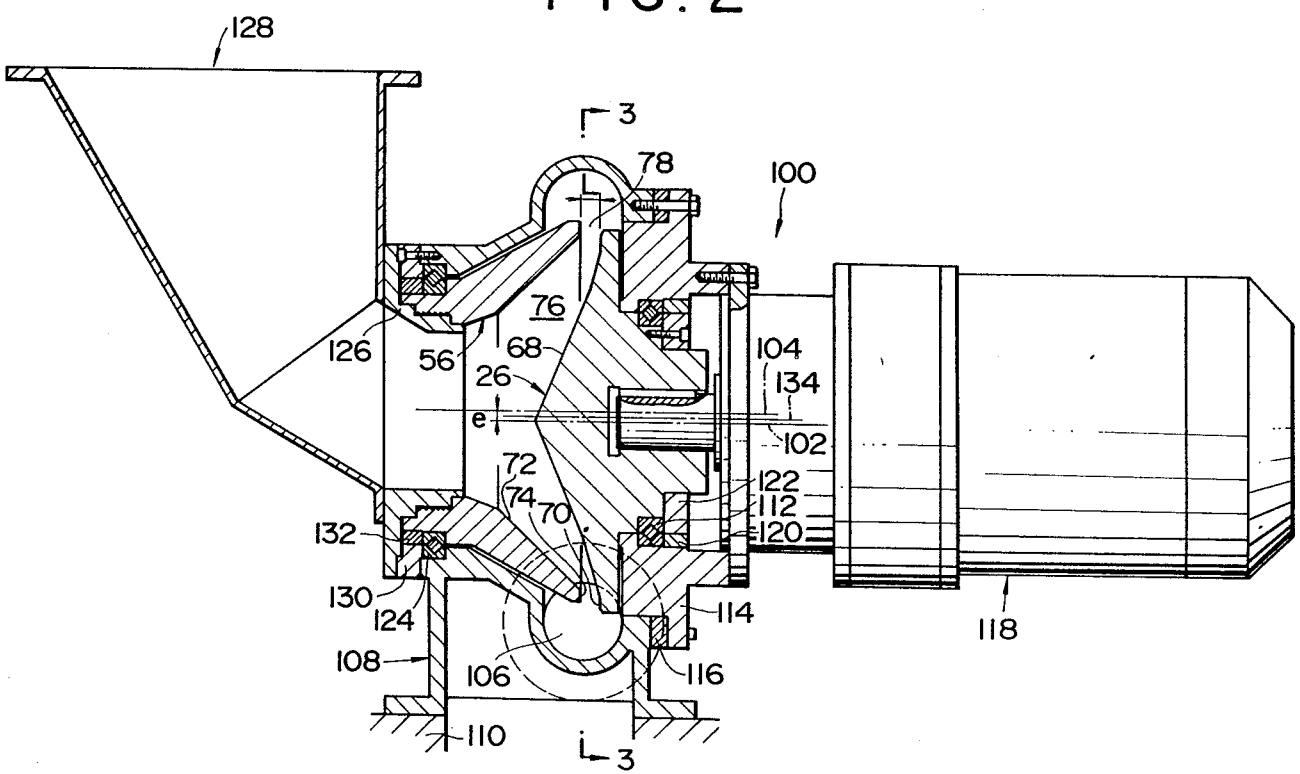
FIG. 2 is a longitudinal cross-sectional view showing another embodiment of the crushing machine according to the present invention.
Figure 3:
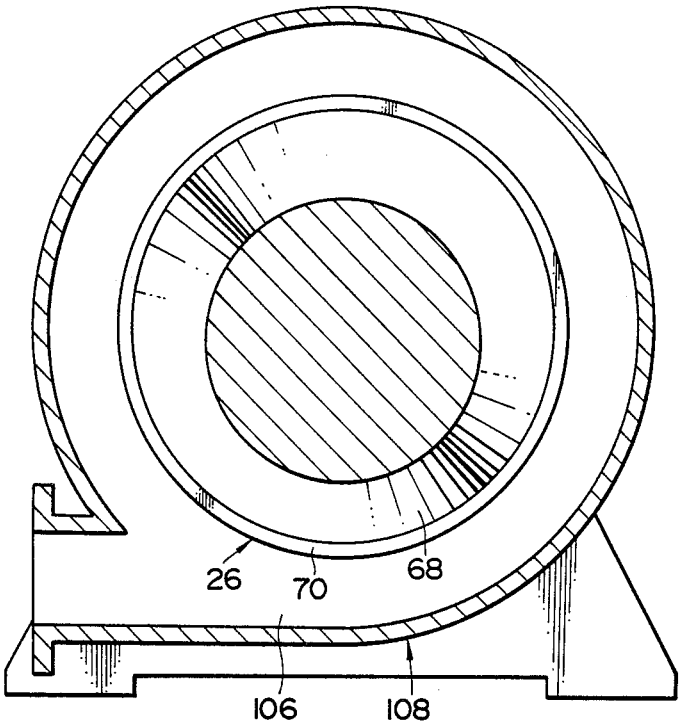
FIG. 3 is a sectional view taken along a line 3—3 in FIG. 2.

A crushing machine 100 as shown in FIGS. 2 and 3 is assembled in a horizontal orientation so that the first and second rotors 26 and 56 are rotated about axes 102, 104 extending in the horizontal direction respectively.

The crushing machine 100 comprises a body 108 defining a space 106 for receiving crushed granular substances spattered from the crushing chamber 76 defined by the rotors 26, 56. The body 108 is installed on a frame bed 110 by a plurality of struts extending downwardly from portions defining the space 106.

The body 108 has openings bored in opposite ends of the body in the horizontal direction. A support ring 114 for rotatably supporting the first rotor 26 is fitted in one opening of the body 108 through a bearing 112. The support ring 114 is removably mounted on the body 108 through a space or a ring 116 by a plurality of bolts. The support ring 114 supports a drive mechanism 118 for rotating the first rotor 26 about the axis 102.

Further, instead of rotating the first rotor 26 by the drive mechanism 118, the second rotor 56 may be rotated or both of the rotors may be rotated by the common drive mechanism or different drive mechanisms.

In the illustrated embodiment, use is made of a cross roller bearing as the bearing 112. The bearing 112 is prevented from dropping out of the support ring 114 and first rotor 26 by the use of a bearing holder 120 mounted on the support ring 114 and a bearing holder 122 mounted on the first rotor 26.

The other opening of the body 108 rotatably supports the second rotor 56 through a bearing 124, while a cover 126 for protecting the bearing 124 and a hopper 128 for receiving the substances to be crushed are mounted on the other opening by a plurality of bolts. The hopper 128 is opened upwardly so as to receive the substances to be crushed from above and guides the received substances to be crushed into the crushing chamber 76.

Use is also made of a cross roller bearing as the bearing 124. The bearing 124 is also prevented from dropping out of the body 108 and second rotor 56 by the use of a bearing holder 130 mounted on the body 108 and a bearing holder 132 mounted on the second rotor 56.

The rotary axis 102 of the first rotor 26 is displaced in one direction by a distance of a half of "e" from an axis 134, which depends on the position where the support ring 114 is fitted in the body 108. On the contrary, the second rotor 56 is displaced in the direction opposite to the aforementioned direction by a distance of a half of "e" from the axis 134. However, by changing the position where the support ring 114 is mounted on the body 108 around the axis 134, the eccentricity between the first and second rotors 26, 56 may be varied within the range from 0 to "e". Further, in the case of the crushing machine 100, the axes 102, 104 and 134 may be inclined to each other slightly, preferably by an equal angle.

The surfaces 70, 74 of the first and second rotors 26, 56 make a right angle with respect to the axis 134. Accordingly, a gap between the surfaces 70, 74 in each portion of the outlet 78 around the axis 134 is held constant. However, a gap L of the outlet 78 may be varied by disposing the ring 116, which is of an appropriate thickness, between the body 108 and the support ring 114.

In operation, the first rotor 26 is rotated about the axis 102 by the drive mechanism 118 at high speed and the substances to be crushed are dumped into the hopper 128. While the substances to be crushed are not in engagement with the convex surface 68 and concave surface 72, the second rotor 56 is not rotated. However, when the substances to be crushed are sandwiched between the first and second rotors 26, 56, the second rotor 56 is rotated following the rotation of the first rotor 26.

When the first and second rotors 26, 56 are rotated, the rotors 26, 56 are made to bring about such relative motion that they come closer to each other at a portion around each of the axes 102, 104, while they are separated away from each other at another portion, since the first and second rotors 26, 56 are rotated by being made to be eccentric from each other by a distance indicated by "e". As a result, the substances to be crushed, which are sandwiched between the rotors 26, 56, are crushed by the rotors 26, 56 when the gap between the rotors 26, 56 is narrowed.

The crushed granular substances are moved to the outlet 78 in the crushing chamber 76 by centrifugal force with the rotation of the first rotor 26 and then moved to the body 108 from the outlet 78 to be finally discharged form the space 106.

The crushing machine 100 has not only effects similar to those of the crushing machine 10 but also effects in that the height of the crushing machine is reduced and the adjustment of the eccentricity between the axes 102, 104 and that of the gap of the outlet 78 may be facilitated since each rotary axis of the rotors 26, 56 extends in the horizontal direction.

Figure 4:
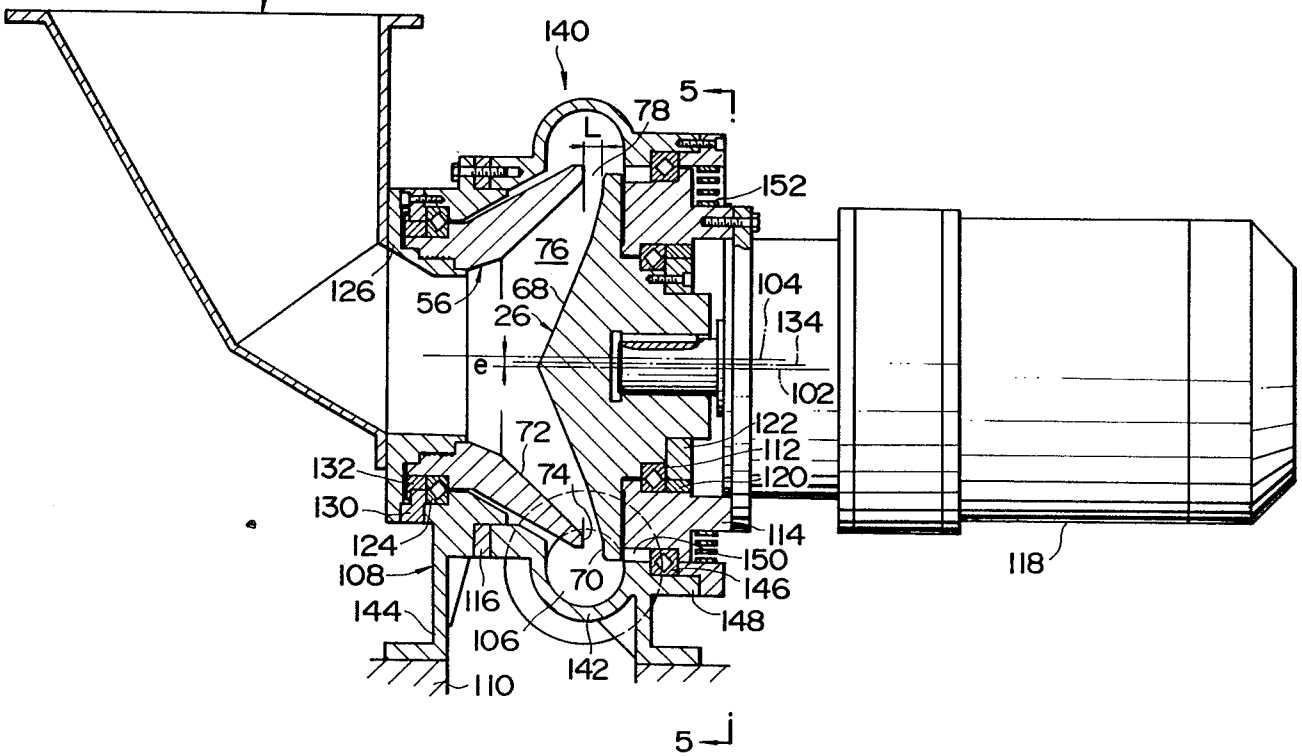
FIG. 4 is a longitudinal cross-sectional view showing a further embodiment of the crushing machine according to the present invention.
Figure 5:
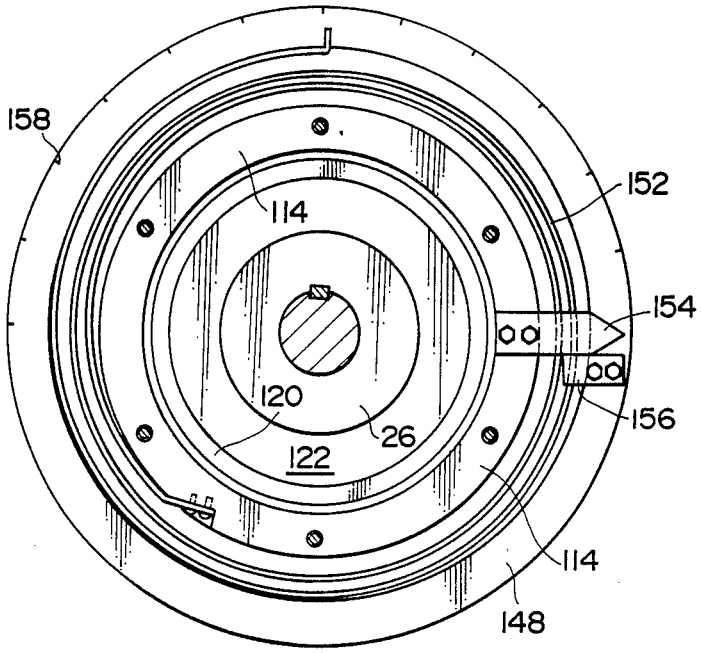
FIG. 5 is a sectional view taken along a line 5—5 in FIG. 4.

FIGS. 4 and 5 show an embodiment of another horizontal crushing machine 140, in which the eccentricity between the first and second rotors 26, 56 is automatically adjusted. The body 108 of the crushing machine 140 is divided into a first body 142 for supporting the support ring 114 such that the second rotor 56 is rotatable about the axis 134 and a second body 144 for supporting the second rotor 56 so as to be rotatable about the axis 104. Both of the bodies 142, 144 are removably connected with each other by a plurality of bolts. The ring 116 is disposed between the bodies 142, 144 so as to vary the gap of the outlet 78.

The support ring 114 is supported by the first body 142 through a bearing 146. Use is made of a cross roller bearing as the bearing 146. The bearing 146 is prevented from dropping out of the first body 142 and support ring 114 by the use of a bearing holder 148 mounted on the first body 142 and a bearing holder 150 mounted on the support ring 114.

A coiled spring 152 is disposed between the first body 142 and the support ring 114. An end of the coiled spring 152 on the center side is fixedly attached to the support ring 114 by a plurality of screws, while the other end on the outer peripheral side is fixedly attached to the first body by a plurality of screws. A pointer 154 for indicating the displacement between the first and second rotors 26, 56 is fixedly attached to the support ring 114. On the contrary, a stopper 156, with which the pointer 154 is capable of being brought into contact, is mounted on the bearing holder 148 fixedly attached to the first body 142, while a scale 158 for the use of the pointer 154 is provided on the bearing holder 148. The coiled spring 152 is previously wound by a predetermined amount.

In operation, the first rotor 26 is rotated about the axis 102 by the drive mechanism 118 at high speed and the substances to be crushed are dumped into the hopper 128. While the substances to be crushed are not in engagement with the convex surface 68 and concave surface 72, the second rotor 56 is not rotated. At this time, the pointer 154 is brought into contact with the stopper 156 by the force of the coiled spring 152.

However, when the substances to be crushed are sandwiched between the first and second rotors 26, 56, the second rotor 56 is rotated following the rotation of the first rotor 26.

When the first and second rotors 26, 56 are rotated, the rotors 26, 56 are made to bring about such relative motion that they come closer to each other at a portion around each of the axes 102, 104 while they are separated from each other at another portion, since the rotors 26, 56 are rotated by being made to be eccentric from each other by a distance indicated by "e". As a result, the substances to be crushed, which are sandwiched between the rotors 26, 56, are crushed by the rotors 26, 56 when the gap between the rotors 26, 56 is narrowed.

When the substances to be crushed are crushed, a large load acts on the first rotor 26, so that a reaction acts on the drive mechanism 118 so as to rotate the drive mechanism 118 in the direction (counter-clockwise in FIG. 5) opposite to the rotating direction of the first rotor 26. Accordingly, the drive mechanism 118 is angularly rotated in the direction opposite to the rotating direction of the first rotor 26 to a position where the reaction, that is, the load is balanced with the force of the coiled spring 152. As a result, the eccentricity between the first and second rotors 26, 56 is lessened to reduce the load acting on the first rotor 26. The eccentricity at this time may be shown by a value of the scale supported by the pointer 154.

The crushed granular substances are moved to the outlet 78 in the crushing chamber 76 by centrifugal force with the rotation of the first rotor 26 and then moved to the outside of the crushing chamber 76 from the outlet 76 to be finally discharged from the space 106.

The crushing machine 140 has not only effects similar to those of the crushing machine 100 but also effects in that the eccentricity between the first and second rotors 26, 56 is automatically adjusted according to the load acting on the first rotor 26.

Further, instead of providing the coiled spring 152, the pointer 154 may be made of an arm and the support ring 114 may be manually rotated to a position where the eccentricity between the first and second rotors 26, 56 comes to a predetermined value, whereby the pointer 154 is releasably fixed in position to the bearing holder 148 so as to maintain the position as noted above. In this case, the pointer 154 is preferably made of the arm.

What is claimed is:

1. A crushing machine, comprising:

crushing means including a first rotary member rotatable about a first axis and a second rotary member rotatable about a second axis, said first and second rotary members being disposed spaced apart from each other in the direction of said first axis to define a crushing chamber for crushing substances between said first and second rotary members, said second rotary member having a hole extending through the central portion thereof in the direction of said second axis for supplying said substances to the crushing chamber, and said crushing chamber having an annular outlet continuously extending about said first axis permitting crushed substances to flow out from said crushing chamber;

drive means for rotating at least one of said first and second rotary members; and support means supporting said first and second rotary members maintaining said annular outlet and defining a space for receiving crushed substances from said crushing chamber, said support means comprising: a first annular support member rotatably supporting said first rotary member; a second annular support member supporting said first support member so as to be angularly rotatable about a third axis which is eccentric from said first axis and rotatably supporting said second rotary member; and means for regulating angular rotational position of said first support member relative to said second support member, said means for regulating including a spring for exerting force to rotate said first support member in a direction opposite to that of said first rotary member; an arm mounted on said first support member; and a stopper ;mounted on said second support member and capable of being brought into engagement with said arm.

2. A crushing machine according to claim 1, wherein said first and second rotary surfaces defining said crushing chamber in cooperation with each other, said first and second crushing surfaces being respectively formed as convex and concave surfaces so that the distance between said first and second crushing surfaces is gradually reduced from said hole in said secondary rotary member toward said outlet.

3. A crushing machine according to claim 1, wherein portions of said first and second rotary members defining said outlet are parallel to each other.

4. A crushing machine according to claim 3, wherein planes defining said outlet are orthogonal to said first and second axes.

5. A crushing machine according to claim 1, wherein said first and second axes are parallel.

6. A crushing machine according to claim 1, wherein said second axis is inclined toward said first axis.

7. A crushing machine according to claim 1, further comprising guide means for guiding said substances to said hole, wherein said guide means is supported by said support means.

* * * * *

UNITED STATES PATENT AND TRADEMARK OFFICE

CERTIFICATE OF CORRECTION

PATENT NO. : 4,964,580

DATED : October 23, 1990

INVENTOR(S) : Toshio Akesaka

It is certified that error appears in the above-identified patent and that said Letters Patent is hereby corrected as shown below:

Claim 2, column 10, line 5, after "rotary", insert --members respectively have first and second crushing--.

Signed and Sealed this

Twenty-fifth Day of February, 1992

*Attest:*

HARRY F. MANBECK, JR.

*Attesting Officer*

*Commissioner of Patents and Trademarks*